US006564817B1

(12) United States Patent
Tseng

(10) Patent No.: US 6,564,817 B1
(45) Date of Patent: May 20, 2003

(54) ANCHORING DEVICE FOR SECURING A CANOPY ON A TENT FRAME

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 5 days.

(21) Appl. No.: 10/011,055

(22) Filed: Dec. 6, 2001

(51) Int. Cl.[7] ..... E04H 15/64
(52) U.S. Cl. ..... 135/119; 135/120.4; 135/907
(58) Field of Search ..... 135/119, 120.4, 135/909, 907

(56) References Cited

U.S. PATENT DOCUMENTS 5,573,028 A * 11/1996 van der Stigohel ..... 135/147
6,155,280 A * 12/2000 Powell et al. ..... 135/124
6,367,495 B1 * 4/2002 Powell et al. ..... 135/122
6,505,638 B1 * 1/2003 Powell et al. ..... 135/124

* cited by examiner

*Primary Examiner*—Robert Canfield
(74) *Attorney, Agent, or Firm*—Ladas & Parry

(57) ABSTRACT

In a tent assembly that includes a tent frame and a canopy, an anchoring device is used to secure the canopy on the tent frame, and includes a retaining unit, an anchor seat and an anchor block. The retaining unit includes an adjustable retaining sleeve to be sleeved on a tent pole of the tent frame, and a retention adjusting member for loosening and tightening the retaining sleeve on the tent pole for height adjustment. The anchor seat is connected to the retaining sleeve and is formed with a rope hole that permits a pull rope on the canopy to extend therethrough. The anchor block is connected to the pull rope, and is disposed below and is limited from moving upward by the anchor seat.

13 Claims, 6 Drawing Sheets

ANCHORING DEVICE FOR SECURING A CANOPY ON A TENT FRAME

BACKGROUND OF THE INVENTION

1. Field of the Invention

The invention relates to an anchoring device for a tent assembly, more particularly to an anchoring device for securing a canopy on a tent frame of a tent assembly.

2. Description of the Related Art

A conventional tent assembly comprises a tent frame and a canopy disposed on top of the tent fame. To anchor the canopy on the tent frame, pull ropes are secured to the periphery of the canopy and are anchored on tent poles of the tent frame. The tent poles may have hooks provided thereon so that the pull ropes can be extended therethrough, wound thereon, and then tied to form knots on the tent frame.

The following are some of the drawbacks of the conventional tent assembly:

1. The quality of anchoring depends on strength control and experience of the people installing the tent assembly. In other words, lack of strength control and inexperience can result in weak anchoring.

2. The anchoring process, which involves winding and knotting of the pull ropes, is slow, inconvenient and cannot be easily controlled.

SUMMARY OF THE INVENTION

Therefore, the main object of the present invention is to provide an anchoring device for securing a canopy on a tent frame of a tent assembly that can overcome the aforesaid drawbacks of the prior art.

Accordingly, the anchoring device of the present invention is adapted for use in a tent assembly that includes a tent frame and a canopy disposed on top of the tent frame. The tent frame includes at least one tent pole, and the canopy has at least one pull rope secured thereto. The anchoring device is adapted to secure the canopy on the tent frame, and comprises a retaining unit, an anchor seat and an anchor block.

The retaining unit includes an adjustable retaining sleeve adapted to be sleeved on the tent pole, and a retention adjusting member for loosening and tightening the retaining sleeve on the tent pole such that the retaining sleeve can be moved a long the tent pole when loosened and can be retained at a desired position on the tent pole when tightened.

The anchor seat is connected to the retaining sleeve and is formed with a rope hole that is adapted to permit the pull rope to extend therethrough.

The anchor block is adapted to be connected to the pull rope such that, when the pull rope is extended through the rope hole, the anchor block will be disposed below and limited from moving upward by the anchor seat.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
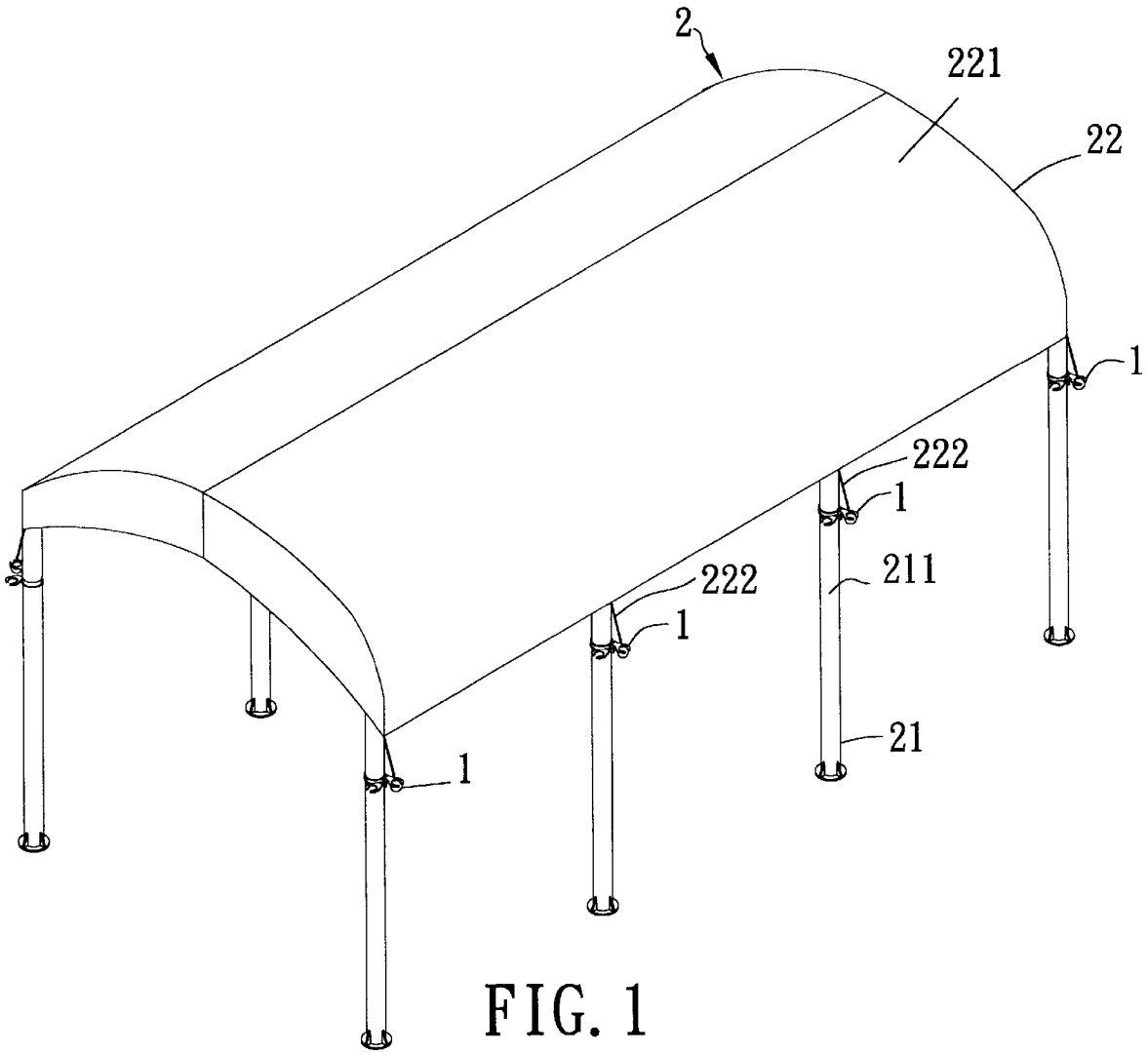
FIG. 1 is a perspective view of a tent assembly that incorporates the preferred embodiment of an anchoring device according to the present invention.
Figure 2:
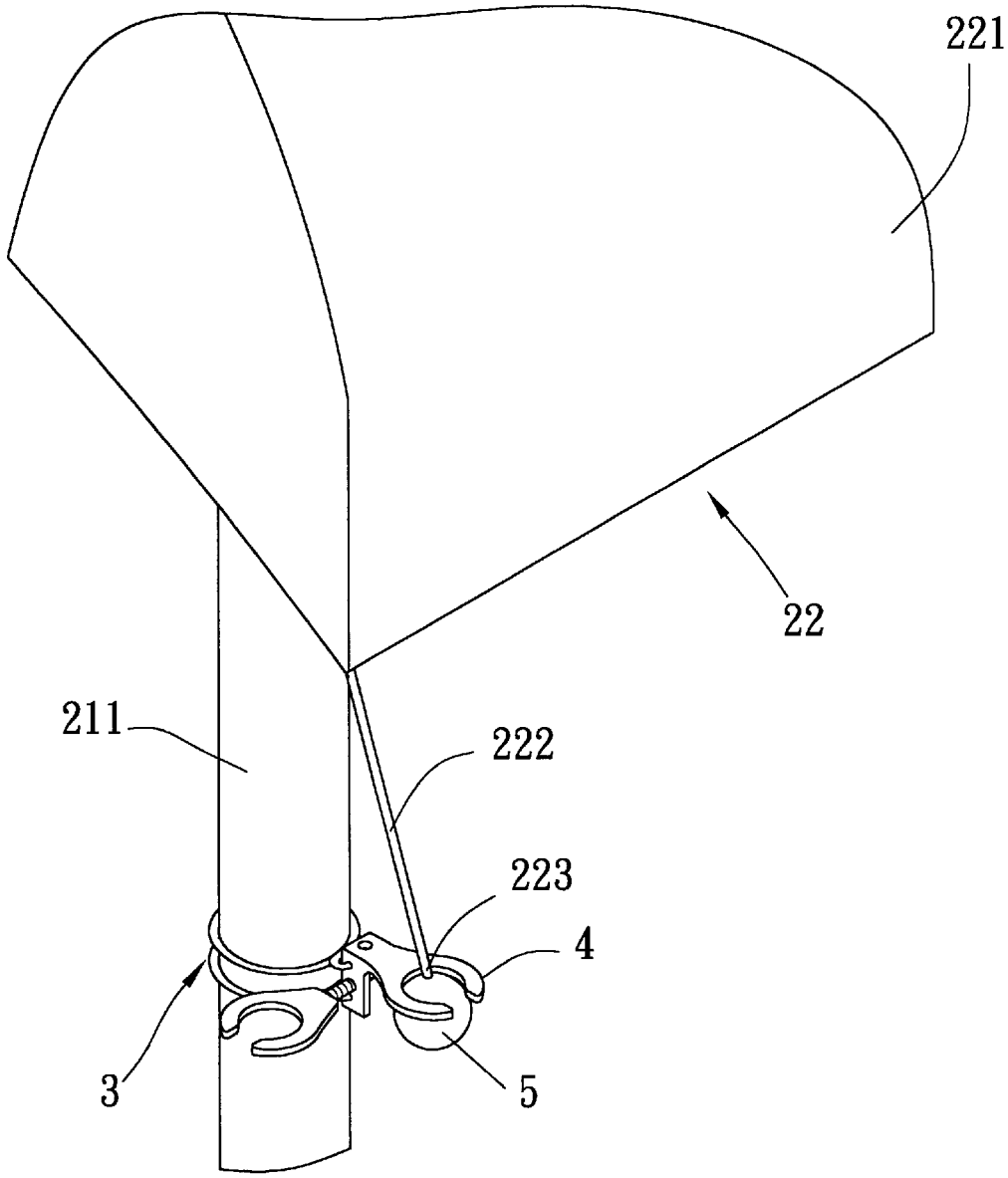
FIG. 2 is a fragmentary perspective view of the tent assembly of FIG. 1.

Referring to FIG. 1, a tent assembly 2 is shown to include a tent frame 21 and a canopy 22 disposed on top of the tent frame 21. The tent frame 21 includes a plurality of tent poles 211 which are connected to each other in a known manner. The canopy 22 includes a hood 221 and a plurality of pull ropes 222 secured to the hood 221. With further reference to FIG. 2, the tent assembly 2 further includes a plurality of anchoring devices 1, each of which is adapted to secure the canopy 22 on the tent frame 21, and comprises a retaining unit 3, an anchor seat 4 and an anchor block 5.

Figure 3:
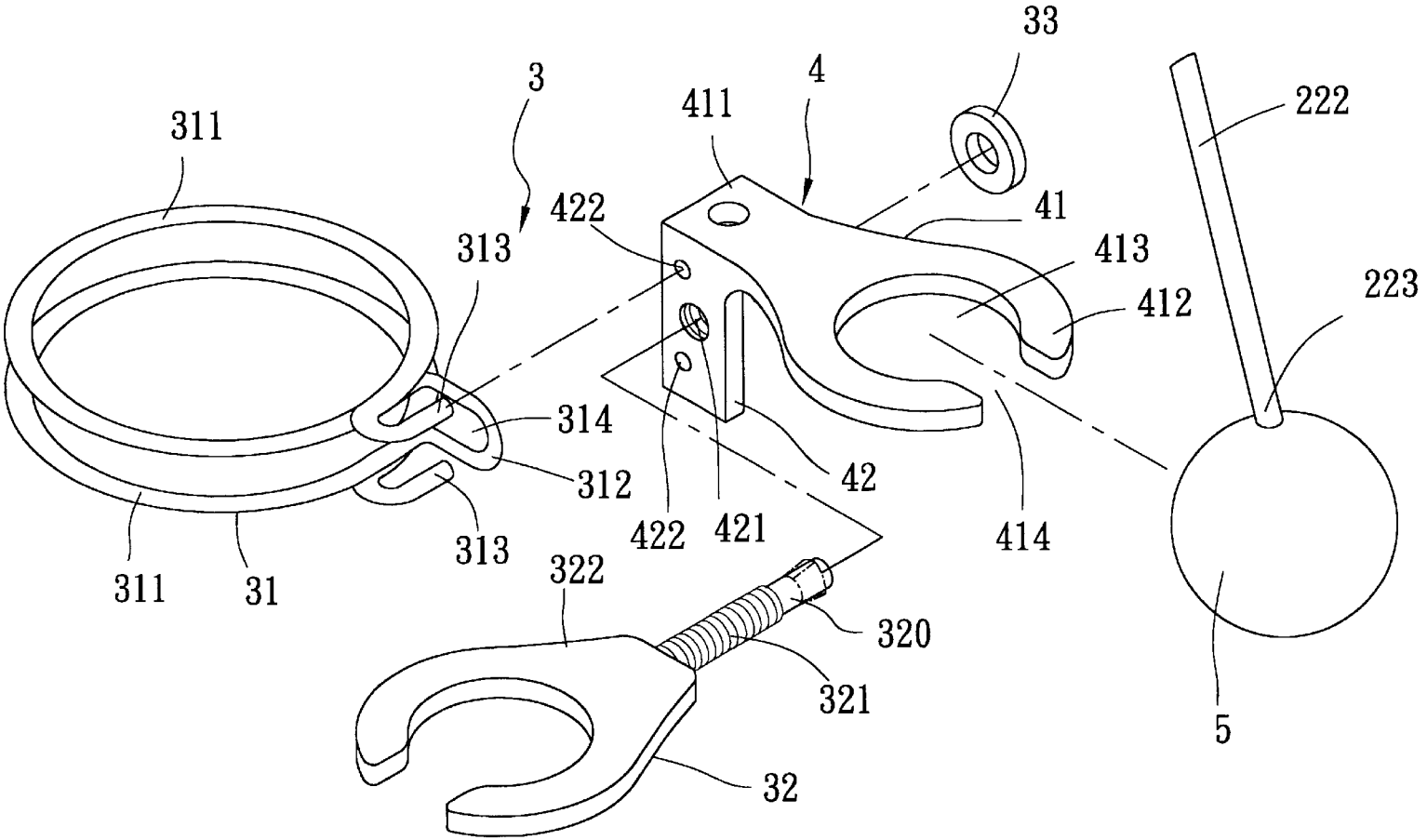
FIG. 3 is an exploded perspective view of the preferred embodiment.

Referring to FIGS. 2 and 3, the retaining unit 3 includes an adjustable retaining sleeve 31 adapted to be sleeved on a respective one of the tent poles 211, and a retention adjusting member 32 for loosening and tightening the retaining sleeve 31 on the respective tent pole 211 such that the retaining sleeve 31 can be moved along the respective tent pole 211 when loosened and can be retained at a desired position on the respective tent pole 211 when tightened. The retaining sleeve 31, which is formed as a bent metal rod, includes coaxial upper and lower helical coil segments 311 that are adapted to be sleeved on the respective tent pole 211. Each of the helical coil segments 311 has a first end 313, in the form of an insert rod, and a second end 312 to be coupled operably to the retention adjusting member 32. In this embodiment, the second ends 312 of the helical coil segments 311 extend radially and outwardly, and are interconnected to form an engaging hole 314. The retention adjusting member 32 includes a bolt member having a threaded shank portion 321 and a diameter-reduced tip 320 that extends from the threaded shank portion 321. A washer 33 is sleeved on the diameter-reduced tip 320. The diameter-reduced tip 320 extends through the engaging hole 314 and is malleated to form a stop flange 3200 (see FIG. 4), thereby retaining the second ends 312 of the helical coil segments 311 between the washer 33 and the stop flange 3200. The bolt member further has a C-shaped operating portion 322 connected to the threaded shank portion 321 opposite to the diameter-reduced tip 320.

The anchor seat 4 includes a horizontally extending claw portion 41 and a vertically extending sleeve connecting portion 42. The claw portion 41 has a connecting end 411 connected to the sleeve connecting portion 42, and a block engaging end 412 formed with a circular rope hole 413 and a radial notch 414. As such, one of the pull ropes 222 can be extended through the rope hole 413 via the radial notch 414. The sleeve connecting portion 42 is formed with a pair of insert holes 422 and a screw hole 421 between the insert holes 422. The first ends 313 of the helical coil segments 311 are inserted into and are secured in the insert holes 422, thereby connecting the anchor seat 4 to the retaining sleeve 31. The threaded shank portion 321 of the bolt member of the retention adjusting member 32 threadedly engages the screw hole 421 in the sleeve connecting portion 42. It should be apparent to one skilled in the art that the particular connection between the adjustable retaining sleeve 31 and the sleeve connecting portion 42 of the anchor seat 4 should not be limited to the insert rod and insert hole arrangement as taught in the preferred embodiment.

The anchor block 5 is adapted to be connected to an anchoring end 223 of one of the pull ropes 222 of the canopy 22 such that, when the pull rope 222 is extended through the rope hole 413 in the anchor seat 4, the anchor block 5 will be disposed below and limited from moving upward by the claw portion 41 of the anchor seat 4. In this embodiment, the anchor block 5 is formed as a sphere with a diameter larger than that of the rope hole 413 in the anchor seat 4.

Figure 4:
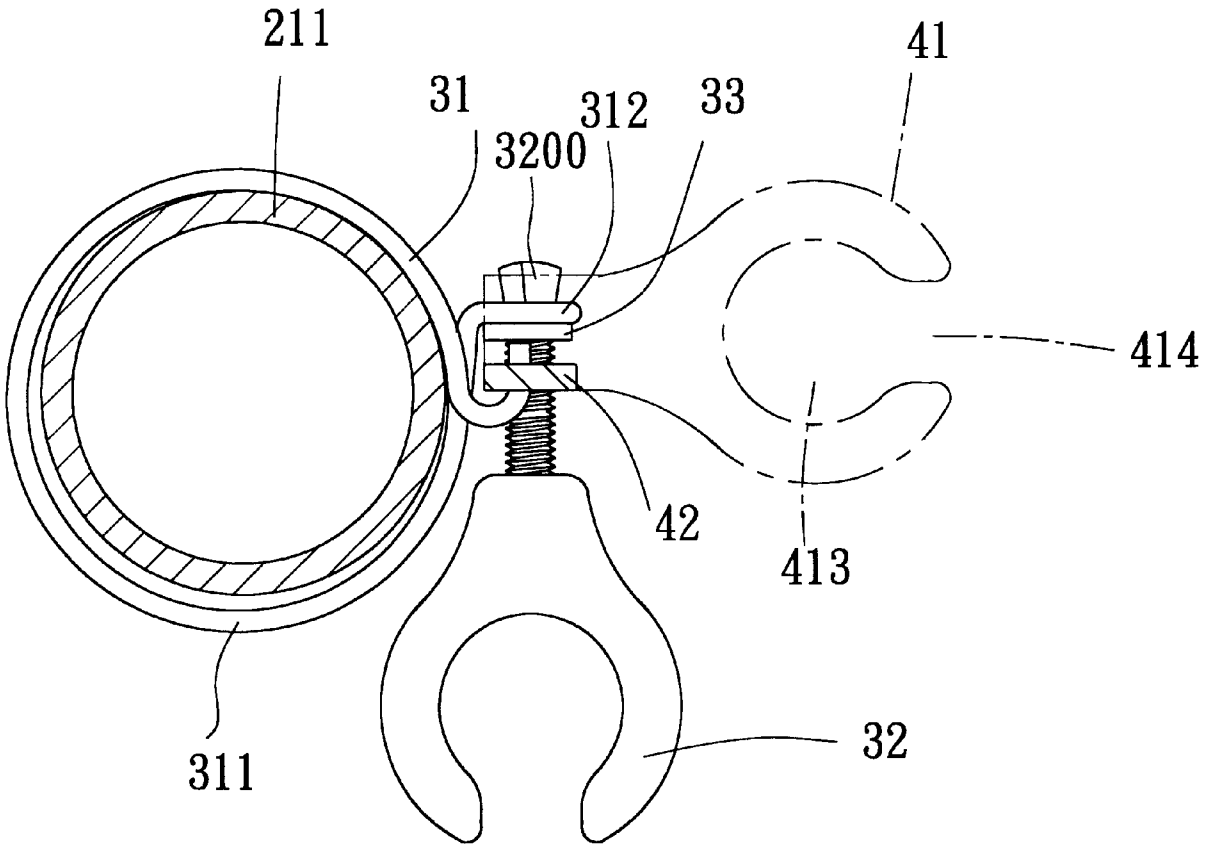
FIG. 4 is a partly sectional view illustrating the preferred embodiment in a loosened state.
Figure 5:
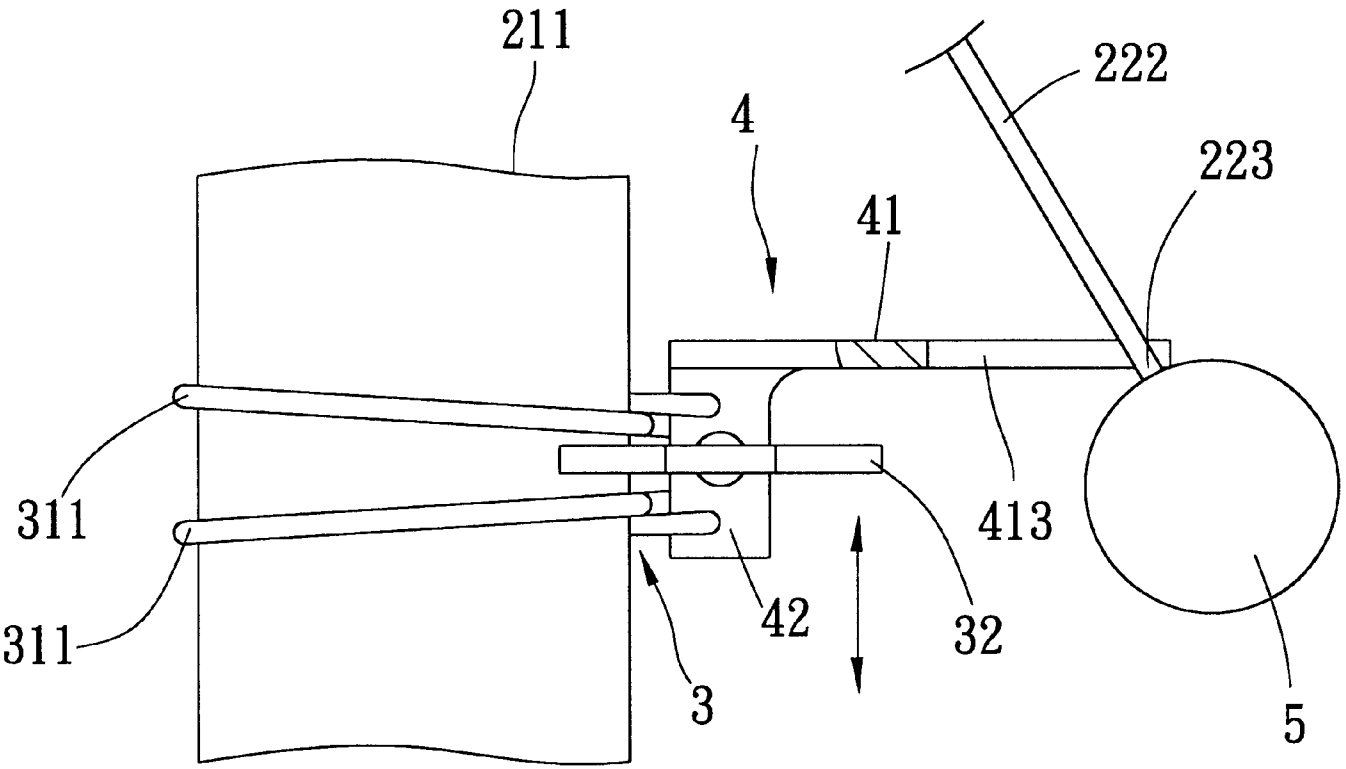
FIG. 5 is a side view illustrating the preferred embodiment when mounted on a tent pole.

Referring to FIGS. 4 and 5, when installing the anchoring device 1, the retention adjusting member 32 is first operated to loosen the retaining sleeve 31. At this time, the distance between the second ends 312 of the helical coil segments 311 and the sleeve connecting portion 42 of the anchor seat 4 is reduced, and the diameter of the helical coil segments 311 is increased so that the retaining sleeve 31 can be moved along the respective tent pole 211 to adjust the height of the anchoring device 1.

Figure 6:
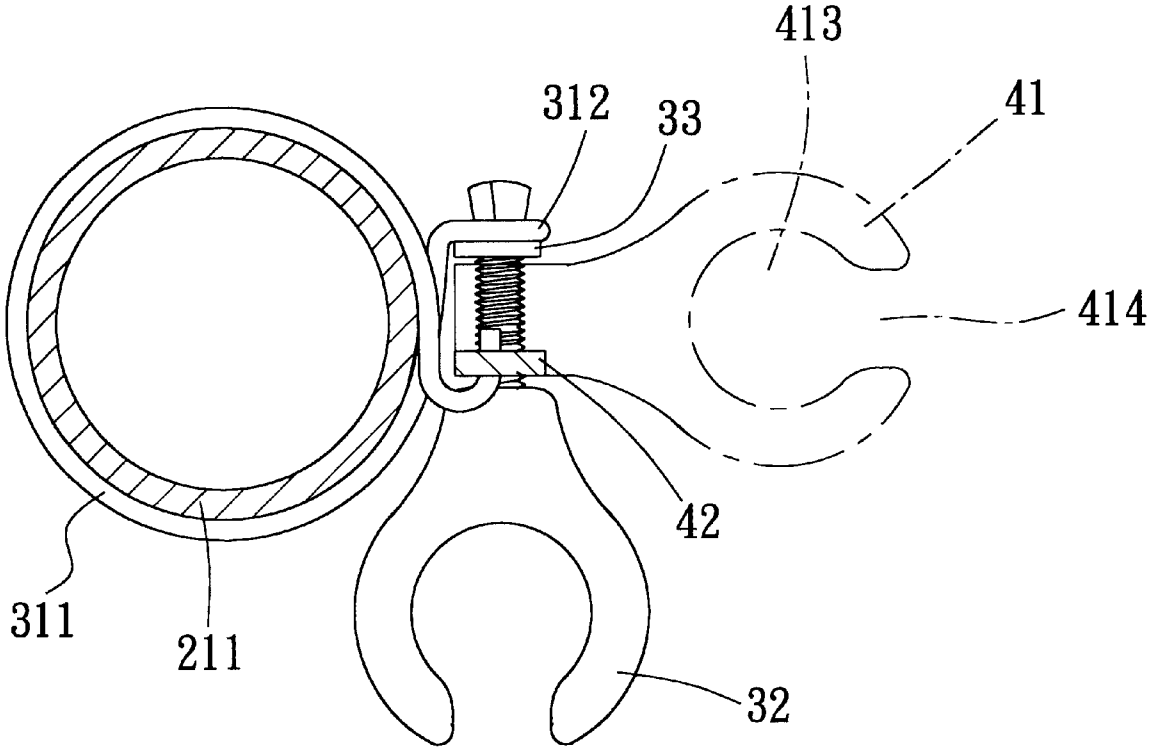
FIG. 6 is a partly sectional view illustrating the preferred embodiment in a tightened state.

Referring to FIG. 6, after adjusting the anchoring device 1 to an appropriate height, the retention adjusting member 32 is operated once again to tighten the retaining sleeve 31. At this time, the distance between the second ends 312 of the helical coil segments and the sleeve connecting portion 42 of the anchor seat 4 is increased, and the diameter of the helical coil segments 311 is reduced such that the retaining sleeve 31 tightly engages the respective tent pole 211, thereby retaining the anchoring device 1 at the desired height on the respective tent pole 211. Subsequently, the pull rope 222 is extended through the rope hole 413 in the claw portion 41 of the anchor seat 4 via the radial notch 414 such that the anchor block 5 is disposed below and is limited from moving upward by the claw portion 41 of the anchor seat 4. In case the pull rope 222 is not sufficiently taut, the retention adjusting member 32 can be operated to loosen the retaining sleeve 31 and permit height adjustment of the anchor seat 4. Since the length and thus the ideal anchoring position of each pull rope 222 of the canopy 22 is fixed, as long as the anchoring devices 1 are disposed at appropriate heights on the tent poles 211 of the tent frame 21, when securing the canopy 22 on the tent frame 21, the only operation that is required is to engage each anchor block 5 with the respective anchor seat 4.

Note that the present invention should not be limited to the particular configuration of the retaining unit 3 in this embodiment. A different retaining unit can be employed as long as it can be loosened and tightened on the respective tent pole.

It is apparent from the foregoing that the anchoring device of this invention can ensure quick, easy and secure installation of a canopy on a tent frame of a tent assembly.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An anchoring device for a tent assembly that includes a tent frame and a canopy disposed on top of the tent frame, the tent frame including at least one tent pole, the canopy having at least one pull rope secured thereto, said anchoring device being adapted to secure the canopy on the tent frame and comprising:

a retaining unit including an adjustable retaining sleeve adapted to be sleeved on the tent pole, and a retention adjusting member for loosening and tightening said retaining sleeve on the tent pole such that said retaining sleeve can be moved along the tent pole when loosened and can be retained at a desired position on the tent pole when tightened;

an anchor seat connected to said retaining sleeve and formed with a rope hole that is adapted to permit the pull rope to extend therethrough; and an anchor block adapted to be connected to the pull rope such that, when the pull rope is extended through said rope hole, said anchor block will be disposed below and limited from moving upward by said anchor seat.

2. The anchoring device as claimed in claim 1, wherein said retaining sleeve includes coaxial upper and lower helical coil segments that are adapted to be sleeved on the tent pole, each of said helical coil segment having a first end that is connected to said anchor seat, and a second end that is operably coupled to said retention adjusting member.

3. The anchoring device as claimed in claim 2, wherein said anchor seat includes a sleeve connecting portion formed with a pair of insert holes and a screw hole, said first end of each of said helical coil segments being secured to said sleeve connecting portion in a respective one of said insert holes, said retention adjusting member including a bolt member having a threaded shank portion that threadedly engages said screw hole in said sleeve connecting portion.

4. The anchoring device as claimed in claim 3, wherein:

said retaining sleeve is formed as a bent metal rod, said second ends of said helical coil segments being interconnected to form an engaging hole that is registered with said screw hole;

said bolt member having a diameter-reduced tip that extends from said threaded shank portion, said retention adjusting member further having a washer that is sleeved on said diameter-reduced tip;

said diameter-reduced tip extending through said engaging hole and being malleated to form a stop flange, thereby retaining said second ends of said helical coil segments between said washer and said stop flange.

5. The anchoring device as claimed in claim 4, wherein said bolt member further has an operating portion connected to said threaded shank portion opposite to said diameter-reduced tip.

6. The anchoring device as claimed in claim 4, wherein said anchor seat includes a claw portion connected to said sleeve connecting portion and formed with said rope hole and a radial notch that permits the pull rope to extend into said rope hole.

7. The anchoring device as claimed in claim 1, wherein said anchor seat includes a claw portion formed with said rope hole and a radial notch that permits the pull rope to extend into said rope hole.

8. The anchoring device as claimed in claim 1, wherein said anchor block is formed as a sphere having a diameter larger than that of said rope hole.

9. A tent assembly comprising:

a tent frame including a plurality of tent poles;

a canopy disposed on top of said tent frame and having a plurality of pull ropes secured thereto; and a plurality of anchoring devices for securing said canopy on said tent frame, each of said anchoring devices including a retaining unit including an adjustable retaining sleeve sleeved on a respective one of said tent poles, and a retention adjusting member for loosening and tightening said retaining sleeve on the respective one of said tent poles such that said retaining sleeve can be moved along the respective one of said tent poles when loosened and can be retained at a desired position on the respective one of said tent poles when tightened, an anchor seat connected to said retaining sleeve and formed with a rope hole that permits a respective one of said pull ropes to extend therethrough, and an anchor block connected to the respective one of said pull ropes such that, when the respective one of said pull ropes is extended through said rope hole, said anchor block will be disposed below and limited from moving upward by said anchor seat.

10. The tent assembly as claimed in claim 9, wherein said retaining sleeve includes coaxial upper and lower helical coil segments that are sleeved on the respective one of said tent poles, each of said helical coil segments having a first end that is connected to said anchor seat, and a second end that is operably coupled to said retention adjusting member.

11. The tent assembly as claimed in claim 10, wherein said anchor seat includes a sleeve connecting portion formed with a pair of insert holes and a screw hole, said first end of each of said helical coil segments being secured to said sleeve connecting portion in a respective one of said insert holes, said retention adjusting member including a bolt member having a threaded shank portion that threadedly engages said screw hole in said sleeve connecting portion.

12. The tent assembly as claimed in claim 11, wherein:

said retaining sleeve is formed as a bent metal rod, said second ends of said helical coil segments being interconnected to form an engaging hole that is registered with said screw hole;

said bolt member having a diameter-reduced tip that extends from said threaded shank portion, said retention adjusting member further having a washer that is sleeved on said diameter-reduced tip;

said diameter-reduced tip extending through said engaging hole and being malleated to form a stop flange, thereby retaining said second ends of said helical coil segments between said washer and said stop flange.

13. The tent assembly as claimed in claim 12, wherein said anchor seat includes a claw portion connected to said sleeve connecting portion and formed with said rope hole and a radial notch that permits the respective one of said pull ropes to extend into said rope hole.

* * * * *